United States Patent [19]

Lampert

[11] 4,365,222

[45] Dec. 21, 1982

[54] STRIPLINE SUPPORT ASSEMBLY

[75] Inventor: Norman R. Lampert, Lantana, Fla.

[73] Assignee: Bell Telephone Laboratories, Incorporated, Murray Hill, N.J.

[21] Appl. No.: 251,243

[22] Filed: Apr. 6, 1981

[51] Int. Cl.[3] ..... H01P 3/08

[52] U.S. Cl. ..... 333/238; 333/246

[58] Field of Search ..... 333/238, 246, 247; 138/108

[56] References Cited

U.S. PATENT DOCUMENTS 3,560,896 2/1971 Essinger ..... 333/238 X 4,080,579 3/1978 Fassett .

*Primary Examiner*—Paul L. Gensler

*Attorney, Agent, or Firm*—David R. Padnes

[57] ABSTRACT

In a stripline transmission assembly, precise positioning of the metallic conductor (10) within the grounded channel (11) is achieved through the use of one or more support posts (20). Each post is inserted into a hole (30) in the channel bottom and extends through a hole (31) in the metallic conductor.

6 Claims, 4 Drawing Figures

STRIPLINE SUPPORT ASSEMBLY

TECHNICAL FIELD

This invention relates to transmission systems and, more particularly, to a stripline transmission assembly for conducting microwave signals.

BACKGROUND OF THE INVENTION

Striplines have long been used to conduct microwave signals. The stripline comprises a metallic conductor disposed at a predetermined position within a grounded channel. This predetermined position is generally at the geometric center of the channel. With present manufacturing techniques, a stripline can provide the necessary broadband performance at low cost and reduced bulk and weight vis-a-vis other transmission mediums, such as coaxial cable and rigid waveguides.

Striplines are generically classified as dielectric spaced or air spaced. In dielectric spaced striplines, support for the metallic conductor is provided by a continuous sheet of dielectric material while in air spaced striplines the amount of dielectric material is reduced to a minimum by using spaced supports. Air spaced striplines are particularly advantageous since the signal attenuation per unit distance is less than with dielectric supported striplines. The problem with air spaced striplines, however, is that the existing support structure does not precisely maintain the predetermined position of the center conductor. This mislocation of the center conductor produces signal perturbations which increase with signal frequency. In the signal frequency used in telecommunications applications, these signal perturbations are particularly acute and troublesome.

SUMMARY OF THE INVENTION

In accordance with the present invention, improved microwave transmission performance is achieved through the use of a stripline transmission assembly which precisely maintains the position of the metallic conductor within a grounded channel. Such positioning is achieved through the use of one or more support posts. Each support post engages with holes in the metallic conductor and channel surface. In the disclosed embodiment, the cross-sectional geometry of each support post is selected to maintain each post substantially perpendicular to the bottom and to facilitate insertion of the support post through the stripline hole while rendering removal difficult.

DETAILED DESCRIPTION

Figure 1:
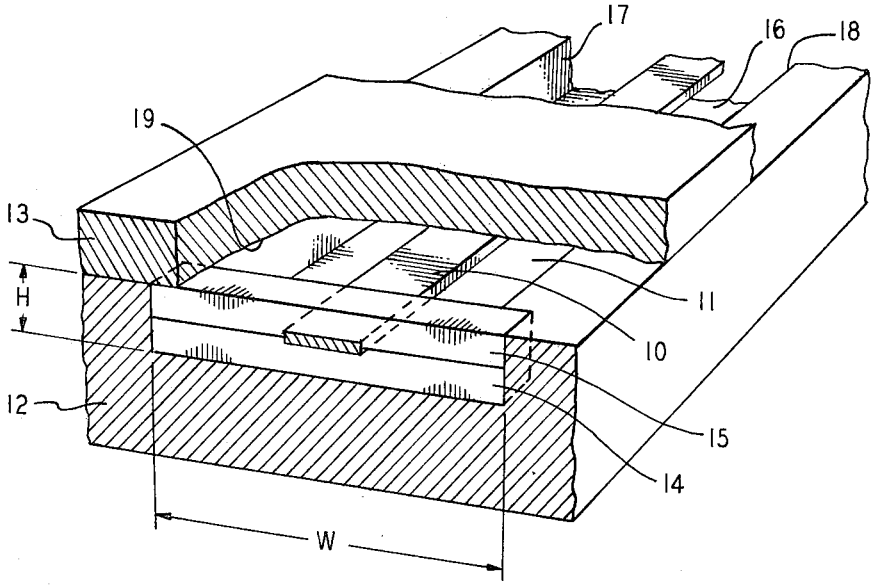
FIG. 1 (PRIOR ART)
FIG. 1 is a perspective view of a prior art stripline assembly.

An existing air-spaced stripline assembly which conducts microwave signals is shown in FIG. 1. This assembly comprises a metallic conductor 10 disposed in a predetermined position within a channel 11 formed by trough 12 and cover 13. The surfaces 16, 17, 18 and 19 defining channel 11 are planar and are electrically connected (not shown) to a reference potential, such as ground. Conductor 10 and channel 11 both have a rectangular cross section and conductor 10, as is the typical case, is centrally positioned with respect to the channel height H and channel width W. The particular geometry of the channel and conductor cross section are determined by well known, but rather complex, equations nd empirical knowledge. Based on these equations and empirical knowledge, holes through conductor 10 or other abrupt geometric changes in the conductor are avoided in order to minimize signal noise.

One or more pairs of support bars 14 and 15, fabricated from a dielectric material, provide the physical support for conductor 10 and maintain the position of conductor 10 within channel 11. Bars 14 and 15 are respectively disposed above and below conductor 10 and completely extend across the channel width W.

The problem with the use of support bars 14 and 15 is that they only maintain the position of conductor 10 with respect to the channel height H and do not preclude movement of conductor 10 along the channel width W. Moreover, each pair of support bars 14 and 15 completely fills the channel cross section. These two factors produce signal perturbations which become more pronounced as the frequency of the transmitted signal increases. At signal frequencies of 11 GHz and higher, the magnitude of such perturbations are particularly undesirable in many telecommunications applications.

Figure 2:
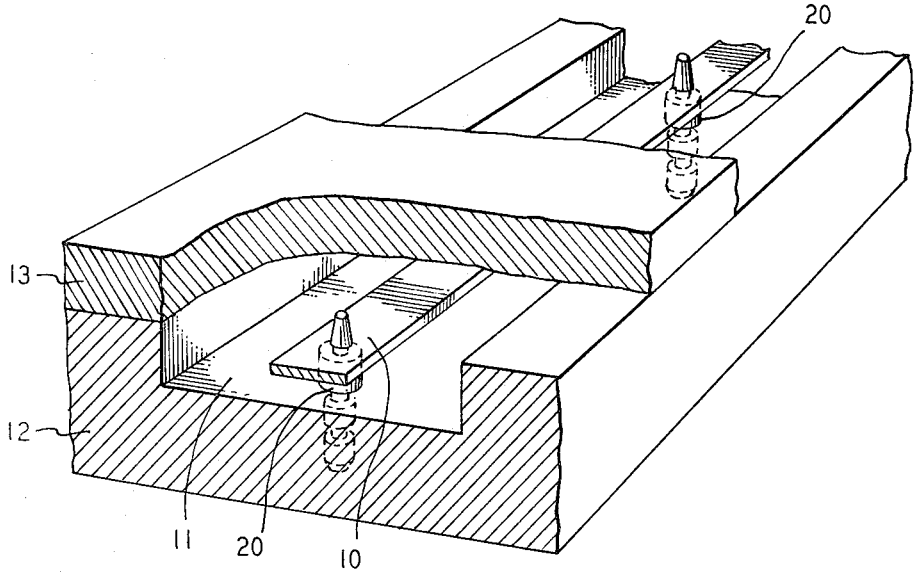
FIG. 2 is a perspective view of a stripline support assembly illustrating the present invention.
Figure 3:
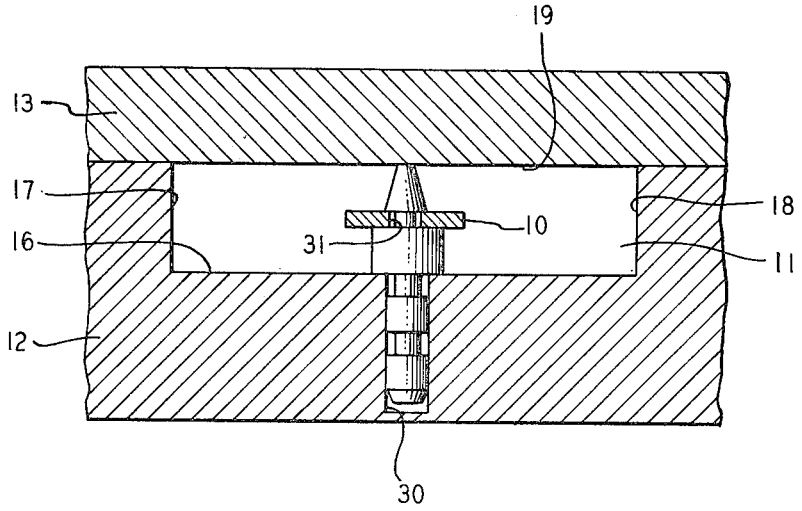
FIG. 3 is an end view of FIG. 2.

Refer now to FIGS. 2 and 3 which show an airspaced stripline assembly having improved transmission performance through the use of support posts 20. Each support post slidingly engages an aperture 30 in planar bottom 16 of channel 11 and extends through an aperture 31 in the center of conductor 10. Use of such posts provide the requisite support for conductor 10 while precisely maintaining its position with respect to both the channel width W and height H. Such accurate positioning, therefore, reduces or eliminates the well known use of tuning screws to eliminate signal discrepancies. Moreover, each post has a considerably smaller cross sectional geometry than the support bar structure to reduce undesirable signal disturbances.

Figure 4:
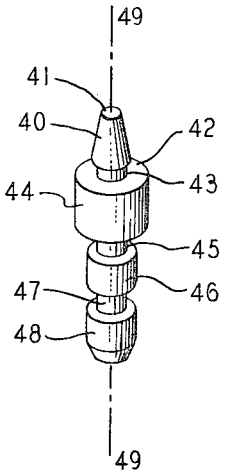
FIG. 4 is a perspective view of the support posts shown in FIGS. 2 and 3.

To provide accurate positioning of conductor 10 within channel 11, each post is advantageously provided with the geometry shown in FIG. 4. Section 40 which is inserted through aperture 31 in conductor 10 is tapered. The diameter of section 40 gradually increases from a diameter considerably smaller than the diameter of aperture 31 at post end 41 to a diameter slightly larger than the diameter of aperture 31 at interior post position 42. Interior post position 42 is adjacent to the top surface of conductor 10 after insertion of post 20 through conductor 10.

The above-described geometry facilitates the insertion of post 20 through aperture 31 while rendering removal of the post difficult. Section 43, adjacent to section 40, is within conductor aperture 31 and is substantially the same diameter thereof. Section 44 is adjacent to section 43 and has a diameter considerably larger than the diameter of conductor aperture 31 to provide support stability. Sections 45, 46, 47 and 48, which sequentially follow one another, and have their planar ends substantially perpendicular to the longitudinal axis of the post, extend into aperture 30. The diameters of sections 45 and 47 are considerably smaller than the diameter of aperture 31 while sections 46 and 48 have a diameter equal to or slightly larger than the diameter of aperture 30. This alternating size of sections 45 through 48 allows the displacement of fine debris within aperture 30 to positions adjacent to sections 45 through 47. This displacement assures perpendicularity of post 20 with respect to planar bottom 16 of channel 11. As a result, conductor 10 is maintained parallel to channel bottom 16 and at a predetermined elevation thereof to minimize signal perturbations. Section 48 at inserted end 49 of post 20 may also be tapered, as illustrated, to facilitate post insertion into aperture 30.

Improved transmission of an 11 GHz signal has been achieved with a stripline assembly using support posts 20. Each post was inserted into a 0.0225 inch (in.) diameter hole in a 0.080 in. wide by 0.010 in. thick conductor and a 0.029 in. hole in the channel bottom. The diameter of section 40 varied from 0.025 in. at interior position 42 to 0.010 in. at end 41. The diameters of sections 43, 44, 45, 46, 47 and 48 were 0.020 in., 0.050 in., 0.020 in., 0.030 in., 0.020 in. and 0.030 in., respectively. The post material should preferably be fabricated from a dielectric material having a radio frequency loss characteristic close to that of air at the transmitted signal frequency. At 11 GHz, phenylene oxide is a suitable dielectric material.

What is claimed is:

1. A stripline transmission assembly for conducting microwave energy propagating at a predetermined frequency, said assembly comprising a channel (11) having a flat bottom (16) with at least one blind hole (30) therein and parallel planar sidewalls (17,18) substantially perpendicular to said flat bottom;

a metallic conductor (10) of predetermined thickness and width disposed in a predetermined position in said channel and having at least one second hole which extends completely through said conductor thickness, the diameter at said second hole being substantially less than the width of said conductor;

at least one support post (20) which maintains said conductor at said predetermined position, each post extending from one of said holes completely through one of said second holes and ending at a location substantially aligned with the extending ends of said sidewalls, said post being fabricated from a dielectric material having a radio frequency loss characteristic close to that of air at said predetermined frequency; and a planar cover (13) extending between the parallel sidewalls of said channel.

2. The stripline assembly of claim 1 wherein each of said holes are aligned with a corresponding one of said second holes.

3. The stripline transmission assembly of claim 2 wherein the length of post within the channel bottom hole comprises a first cylindrical portion (48) beginning at the post end successively followed by second (47), third (46) and fourth (45) cylindrical portions, the planar ends of said first, second, third and fourth portions being perpendicular to the longitudinal axis of the post, the diameters of said first and third portions being equal to or greater than the diameter of the channel bottom hole while the diameters of said second and fourth portions are smaller than the diameter of the channel bottom hole.

4. The stripline transmission assembly of claim 3 wherein the length of each post inserted through one of said second holes comprises a fifth tapered portion (40) which extends from said conductor toward said cover, the larger end of said fifth portion being adjacent to said conductor.

5. The stripline assembly of claim 4 wherein the length of each post inserted through one of said second holes comprises a sixth cylindrical portion (43) with planar ends substantially perpendicular to the longitudinal axis of the post and which lies within each second hole and is in sliding engagment therewith.

6. The stripline transmission assembly of claim 5 wherein each post comprises a seventh cylindrical portion (44) between said conductor and said channel bottom, the planar ends of said seventh cylindrical portion being substantially perpendicular to the longitudinal axis of the post and the diameter of said seventh portion being greater than the diameters of said hole and second hole.

* * * * *